US007011237B1

(12) United States Patent
Sayers et al.

(10) Patent No.: US 7,011,237 B1
(45) Date of Patent: Mar. 14, 2006

(54) DIP TUBE FOR USE WITH A CONTAINER PUMP

(75) Inventors: Richard C. Sayers, Akron, OH (US); Nick E. Ciavarella, Seven Hills, OH (US); Mark E. Rosenkranz, Parma, OH (US); Daniel M. Willis, Mantua, OH (US)

(73) Assignee: Joseph S. Kanfer, Richfield, OH (US)

( * ) Notice: Subject to any disclaimer, the term of this patent is extended or adjusted under 35 U.S.C. 154(b) by 169 days.

(21) Appl. No.: 10/723,641

(22) Filed: Nov. 26, 2003

Related U.S. Application Data

(63) Continuation-in-part of application No. 10/162,741, filed on Jun. 6, 2002, now abandoned.

(51) Int. Cl.
*B65D 88/54* (2006.01)

(52) U.S. Cl. ..... 222/321.9; 222/382; 222/464.3

(58) Field of Classification Search ..... 222/376, 222/382, 321.9, 402.19, 321.4, 464.3
See application file for complete search history.

(56) References Cited

U.S. PATENT DOCUMENTS

| | | | | |
|---|---|---|---|---|
| 994,938 A | | 6/1911 | Larimore | |
| 3,542,254 A | | 11/1970 | Samuelson et al. | |
| 3,893,596 A | | 7/1975 | Beres et al. | |
| 4,277,001 A | | 7/1981 | Nozawa | |
| 4,371,098 A | | 2/1983 | Nozawa et al. | |
| 4,776,498 A | | 10/1988 | Maerte et al. | |
| 5,119,974 A | | 6/1992 | Mann | |
| 5,341,967 A | | 8/1994 | Silvenis | |
| 5,540,360 A | | 7/1996 | Foster et al. | |
| 5,611,467 A | | 3/1997 | Peng | |
| 5,624,060 A | * | 4/1997 | Ellion et al. | 222/376 |
| 5,738,252 A | | 4/1998 | Dodd et al. | |
| 5,775,548 A | | 7/1998 | Hohmann et al. | |
| 5,979,712 A | | 11/1999 | Montaner et al. | |
| 6,036,113 A | | 3/2000 | D'Angelo | |
| 6,394,319 B1 | | 5/2002 | Pucillo | |

FOREIGN PATENT DOCUMENTS

EP 0 968 767 A1 1/2000

* cited by examiner

*Primary Examiner*—Philippe Derakshani
(74) *Attorney, Agent, or Firm*—Renner, Kenner, Greive, Bobak, Taylor & Weber

(57) ABSTRACT

A dip tube assembly for use with a fluid container and a pump attached to the container includes a dip tube support attachable to the pump and disposed in the interior of the container for access to the contents thereof. The dip tube assembly includes a hollow support attachable to the pump and extending downward from a distal end of the pump and opening toward the end of the container to which the pump is attached.

12 Claims, 11 Drawing Sheets

DIP TUBE FOR USE WITH A CONTAINER PUMP

RELATED PATENT APPLICATIONS

This application is a continuation-in-part of U.S. patent application Ser. No. 10/162,741, filed Jun. 6, 2002 now abandoned.

FIELD OF THE INVENTION

This invention relates in general to pumping devices and relates, in particular, to a dip tube attached to a pump mounted on a container and which facilitates more complete exhaustion of the contents of the container when the container is used in an inverted position.

DESCRIPTION OF THE PRIOR ART

Pumping devices and, particularly, pumping devices for use with containers bearing materials which are intended to be dispensed are well known in the art.

This generic type of arrangement has found use in connection with the dispensing of various fluids such as soap, lotion, antibacterial and antimicrobial compositions, foams, etc. for use on the person of end users.

Typically, the container is provided with an attachment member which screws or is otherwise releasably secured to the top of the container and a pump mechanism of any one of the various types commonly available. These pumps are carried by the attachment member and extend into the body of the container for access to the contents with a pumping unit received partially with and partially without the container. A nozzle is then disposed on the external portion of the pumping member for access by the pump user.

Generally, the pumps are connected in fluid communication with the interior of the container by a "dip tube" which extends generally coaxially with the pump so that the distal end of the dip tube is disposed somewhere adjacent the bottom of the container. In operation, of course, activation of the pump draws material up through the dip tube, through the pumping mechanism and out through the nozzle onto the hand of the user.

There are many different variations of these arrangements, but, in general, the aforementioned characteristics are true of all of the various container pumping devices of this type on the market.

In some instances, however, it is desirable to invert the container so that, rather than project from the top, the pumping mechanism and nozzle projects from the bottom. In those situations, generally it is common to mount the container in a holder of some type, such as, a wall-mounted bracket so that the material is dispensed onto the hand of the user by activating the pump mechanism from what might be called the bottom, as contrasted to the top, of the overall container/pump combination.

One difficulty is often encountered, however, in that the normal dip tube would project to what then would be the top of the container and once the container contents are drawn below the distal end of the dip tube, there is no access to the remainder of the content so that, effectively, activation of the pump would simply draw air rather than a mix of air and the container contents which is necessary to create a foamed discharge.

Accordingly, production of a dip tube mechanism which would permit full, or nearly full evacuation, of the contents of the container even if the overall combination is utilized in an inverted condition rather than the normal upright condition is believed desirable.

SUMMARY OF THE INVENTION

It accordingly becomes an object of this invention to provide an improved dip tube structure which can be either used as original equipment or used to convert a conventional pump to one in which the container can be efficiently utilized in an inverted or up-side-down position.

In furtherance of this object, it has been found that if the dip tube device extends toward the normal top or pump end of the container, that access from the distal end of the dip tube to the contents is available at all times until at least the great majority of the contents are exhausted.

In view of at least one of the objects of the present invention, generally provides a combination dip tube assembly and a container pump for use with a container disposed in an inverted condition. The combination including a pump mechanism attached to the container. The pump being moveable between pumping and nonpumping positions for dispensing materials from the container, where the pump includes a dip tube extending between the pump and the interior of the container for drawing material therefrom. The combination further includes an elongate housing that receives a portion of the pump. The dip tube of the combination provides fluid communication between the interior of the container and the pump and extends in substantial parallelism with the housing.

The present invention further provides a pump apparatus for use with a container disposed in an inverted condition. The pump apparatus includes a pump having a nozzle extending exteriorly of the container and a pump housing that extends into the container, where the pump housing is open at a distal end thereof. The pump apparatus further includes a dip tube having a first end attachable to the distal end of the pump housing and a second end extending below the first end.

The present invention further provides a pump apparatus for use in connection with a container disposed in an inverted condition that includes a pump housing received within the container and a nozzle extending exteriorly of the container, where the pump housing has an open distal end. The pump apparatus further includes a cap adapted to fit over a portion of the pump housing including the distal end. The cap defining a channel having a first end that opens into the distal end and a second end that opens into the container, where the second end is located below the first end.

Accordingly, production of an improved dip tube mechanism used with pump-type containers becomes another object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
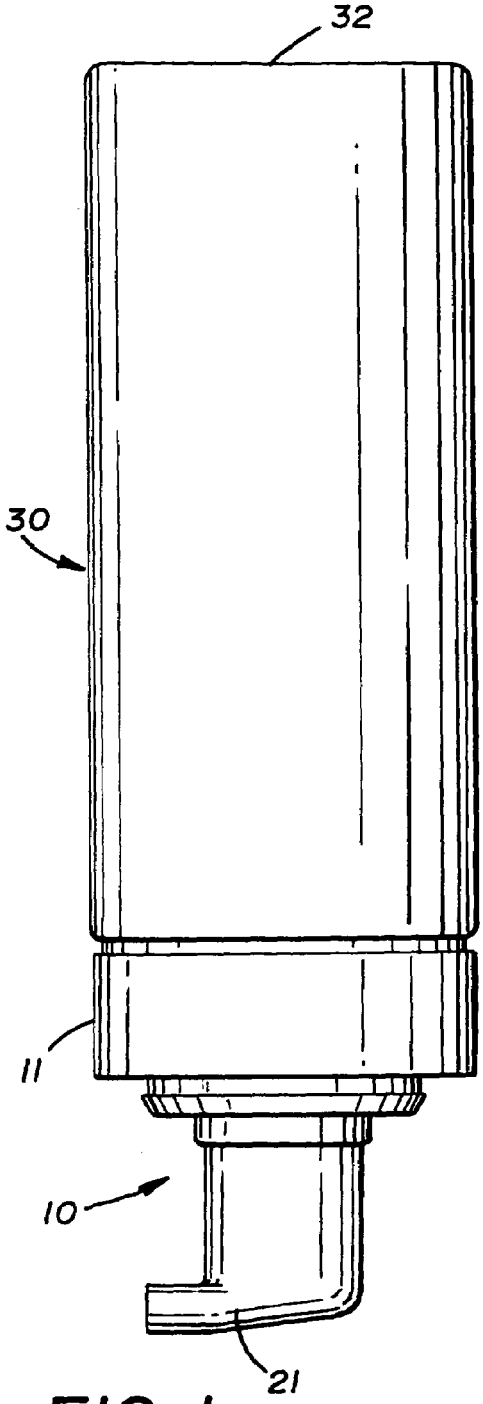
FIG. 1 shows an inverted assembled pump and container.
Figure 2:
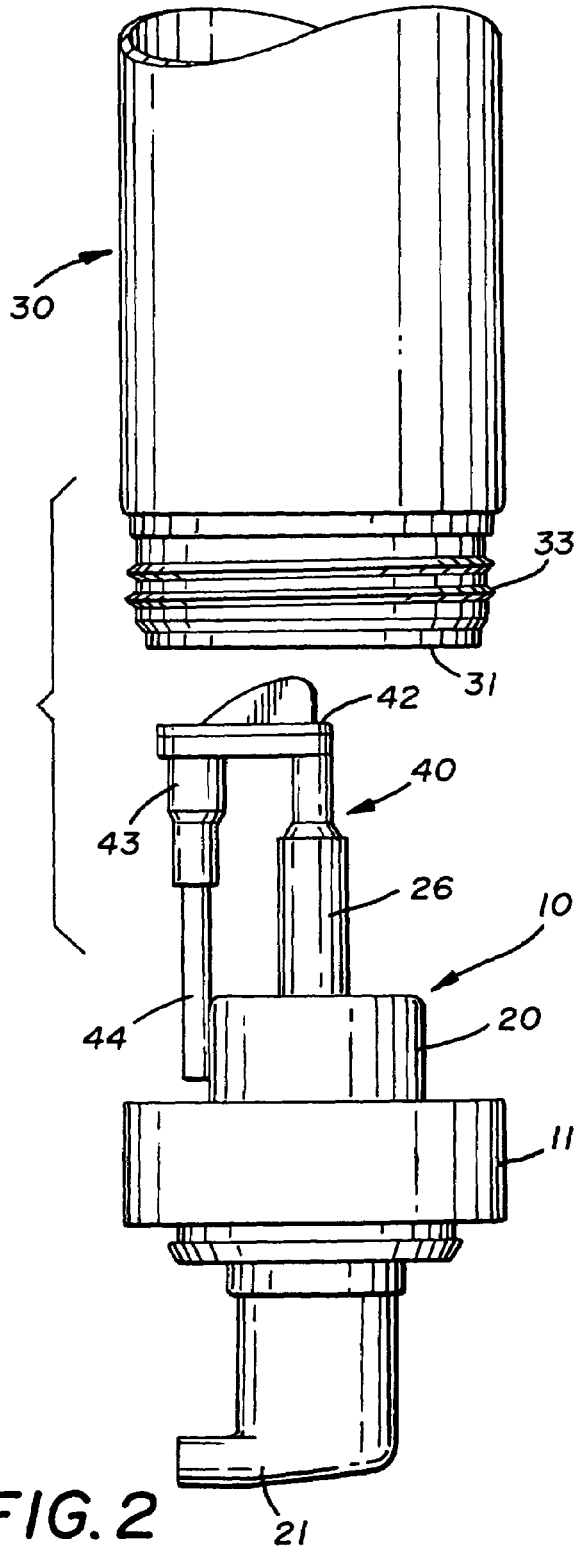
FIG. 2 is an exploded view of the same showing the pump tube apparatus separated from the normal top of the container.

Referring first then to FIGS. 1 and 2 of the drawings, it will be seen that the improved pumping apparatus is generally indicated by the numeral 10 and the container, per se, is generally indicated by the numeral 30. In that regard, the container has a normal top 31 and a normal bottom 32.

The top 31 is threaded as at 33 for receipt of the pumping apparatus 10. In that regard and referring to FIGS. 1, 3 and 4 of the drawings, that apparatus includes an attachment collar 11 which is internally threaded as at 11*a* for mating with the threads 33 on the end 31 of the container 30. A pump 20 is carried by this collar 11 and projects into the interior of the container 30. No great detail will be entered into in describing this pumping apparatus because there are a number of variations and they are well known to those in the art. Suffice it to say, however, that a nozzle end 21 is provided and projects exteriorly of the container for access by the user as can be seen in FIG. 1. A pump rod 22 projects into the interior of the container through pump housing 26 and can be actuated by depressing the nozzle end 21 against the force of the spring 23. A ball check valve represented by the numeral 24 is disposed at the distal end of spring 23 to close off the end of the housing 26 for purposes which will be described.

Figure 3:
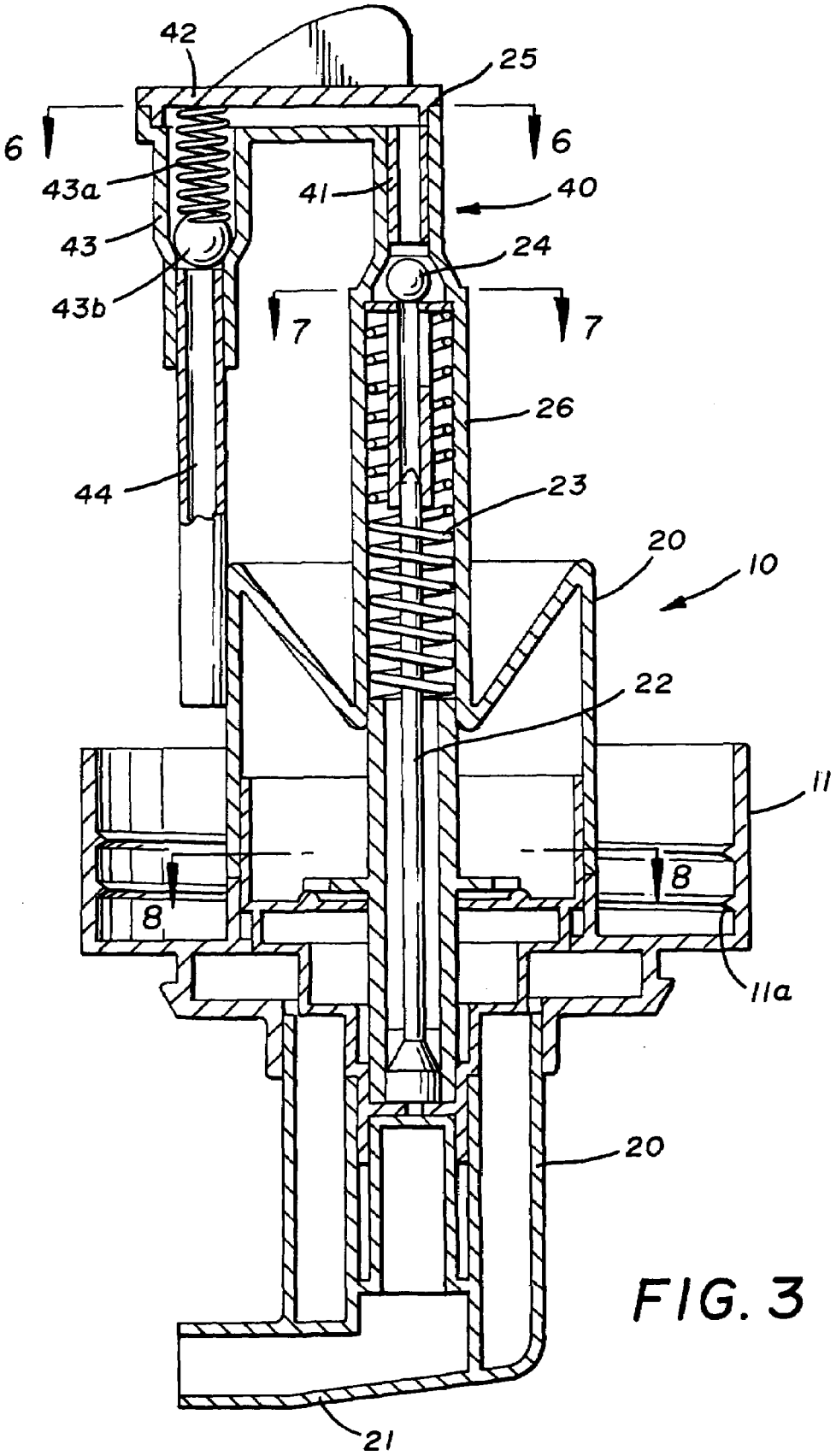
FIG. 3 is a sectional, elevational view showing the improved apparatus in the rest position.
Figure 4:
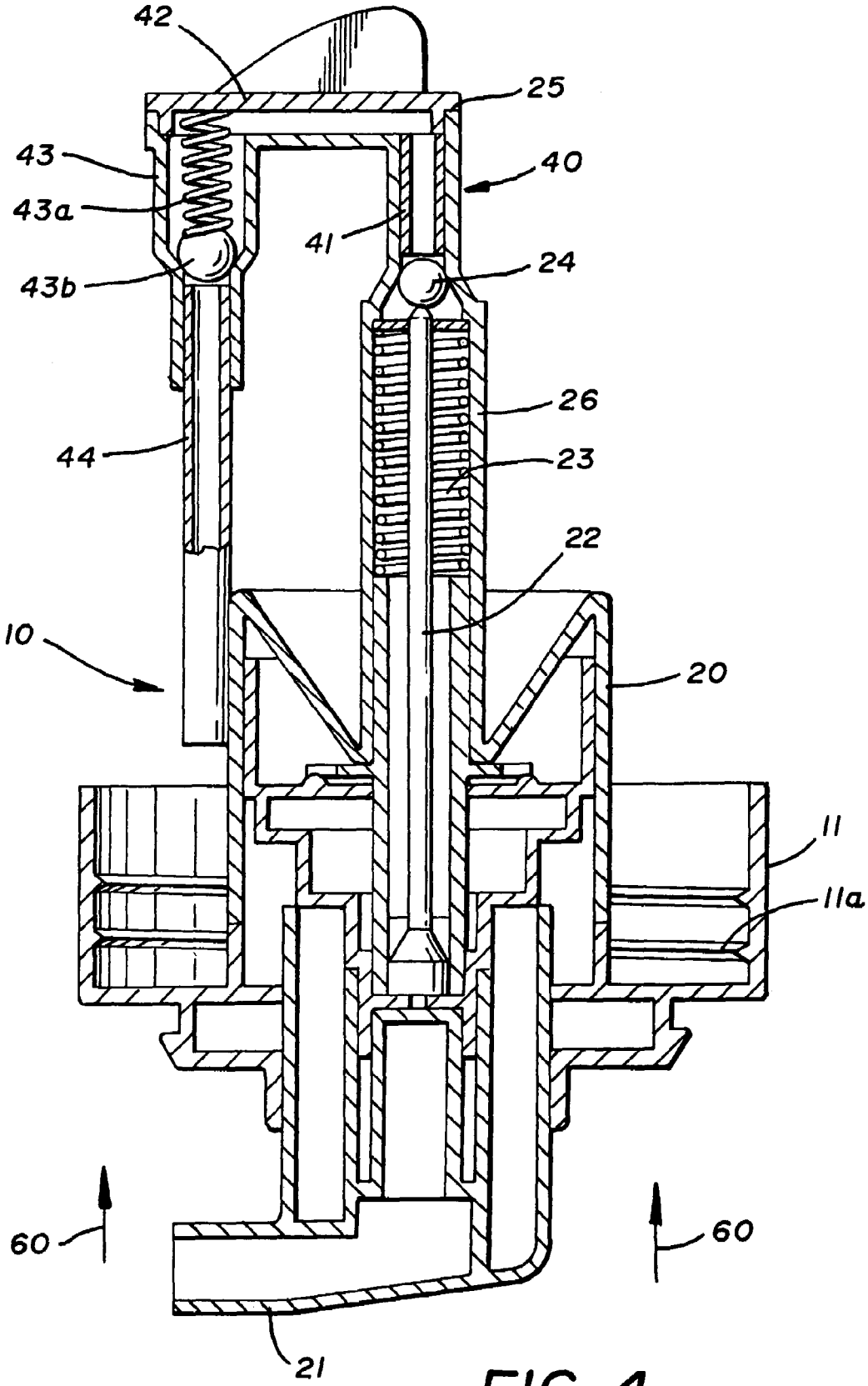
FIG. 4 is a view similar to FIG. 3 showing the apparatus in the pumping condition.
Figure 5:
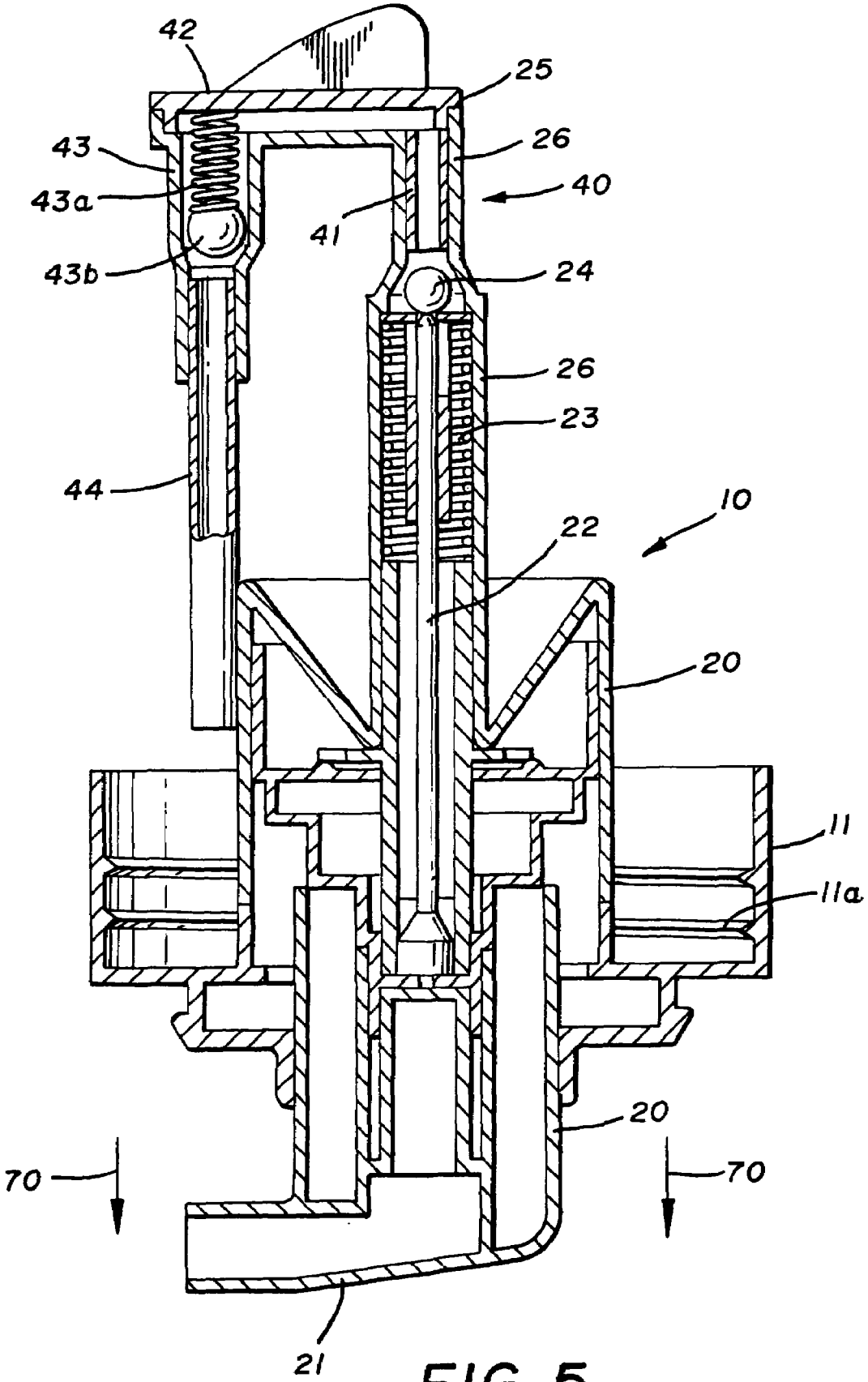
FIG. 5 is a view similar to FIG. 3 showing the apparatus during its return to the position of FIG. 3.
Figure 6:
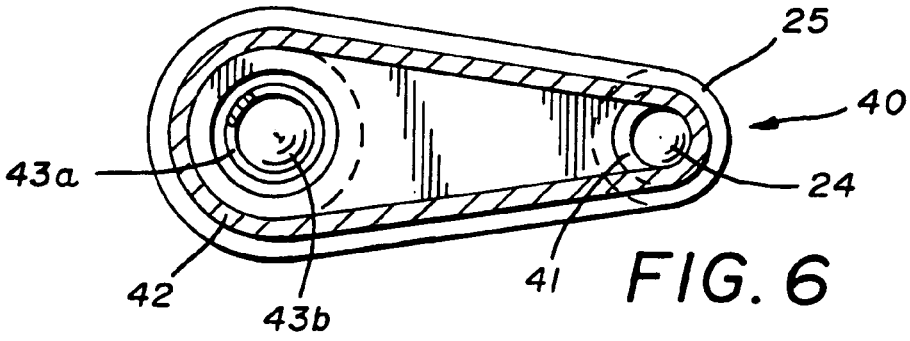
FIG. 6 is a sectional view taken along the line 6—6 of FIG. 3.
Figure 7:
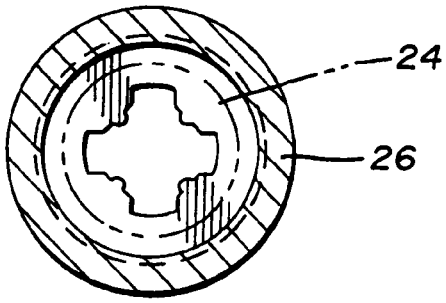
FIG. 7 is a sectional view taken along the line 7—7 of FIG. 3.
Figure 8:
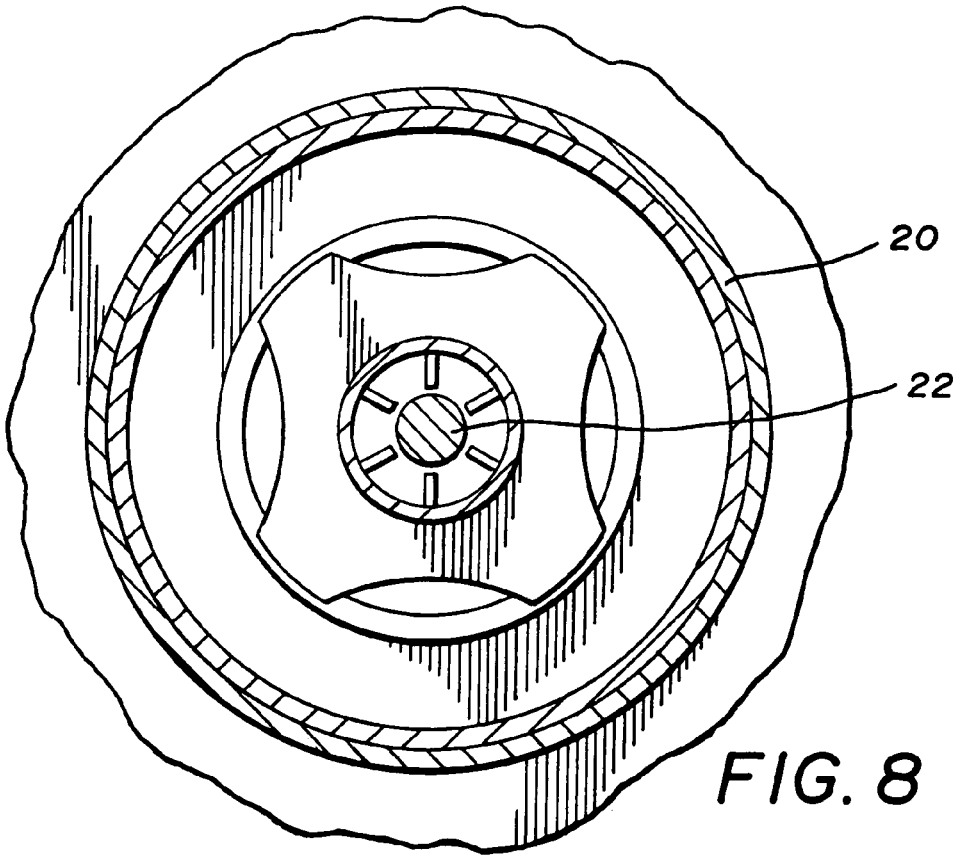
FIG. 8 is a sectional view taken along the line 8—8 of FIG. 3.

Conventionally, a dip tube is received on the distal end 25 of pump housing 26 and is simply an elongate hollow tube which projects coaxially therefrom to a position adjacent the bottom 32 of the container. However, in the present invention a dip tube support, identified by the numeral 40, is utilized. This dip tube support includes a hollow attachment portion 41 which can be press fit on the distal end 25 of the pump housing 26 as shown in FIGS. 3, 4 and 5 of the drawings. A hollow cross piece 42 is provided at the top of the member 41 and extends substantially normally to the end 25 of the pump housing 26 and of the attachment portion 41 of the dip tube housing.

Extending then downwardly and substantially parallel to the pump housing 26 is another hollow leg 43 of the dip tube support which carries a spring 43*a* and a check ball 43*b* and it will be noted that this extends substantially parallel to the pump housing 26 and extends toward what normally would be the top 31 of the container 30, but which, when the container is inverted, becomes the bottom. Press fit or otherwise attached the dip tube leg 43 at its distal end is the dip tube 44 itself which is a hollow, flexible member fabricated of suitable material.

It is noted above that no other description of the pump apparatus per se is believed necessary inasmuch as these pumps are very well known in the art and their construction and operation would be well known to those of ordinary skill in this art. Essentially, upon depression of the external portion of the pump in the direction of arrows 60, as seen in FIG. 4 of the drawings, fluid is drawn into the pumping apparatus 10, mixed with air and dispensed through the nozzle as foam.

It will be seen that the normal pump arrangement can be retrofitted by simply removing the usual dip tube from the end 25 of the pump and replacing it with the leg 41 of the improved dip tube support device 40. Alternatively, of course, this could be original manufacture.

In operation, depression of nozzle end 21 in the direction of arrows 60 actuates the pumping apparatus to move the pump from the position of FIG. 3 to that of FIG. 4 to dispense a charge of material meanwhile closing valve 24 while keeping valve 43*b* closed. When pressure is released on nozzle end 21, as seen in FIG. 5, the pump 20 returns in the direction of arrows 70. Valves 24 and 43*b* are open during this movement to draw a further charge into the device. Upon return to the FIG. 3 position, valve 43*b* returns to the closed position and the assembly is ready for further operation. Thus, while a particular type of ball valving arrangement is illustrated and described it will be noted that other types of valves can also be employed. Likewise, while the description discusses the discharge of a foam material, it should be understood that this is just one example of a flowable material that may be dispensed from the container and the present invention is not limited thereto.

Figure 9:
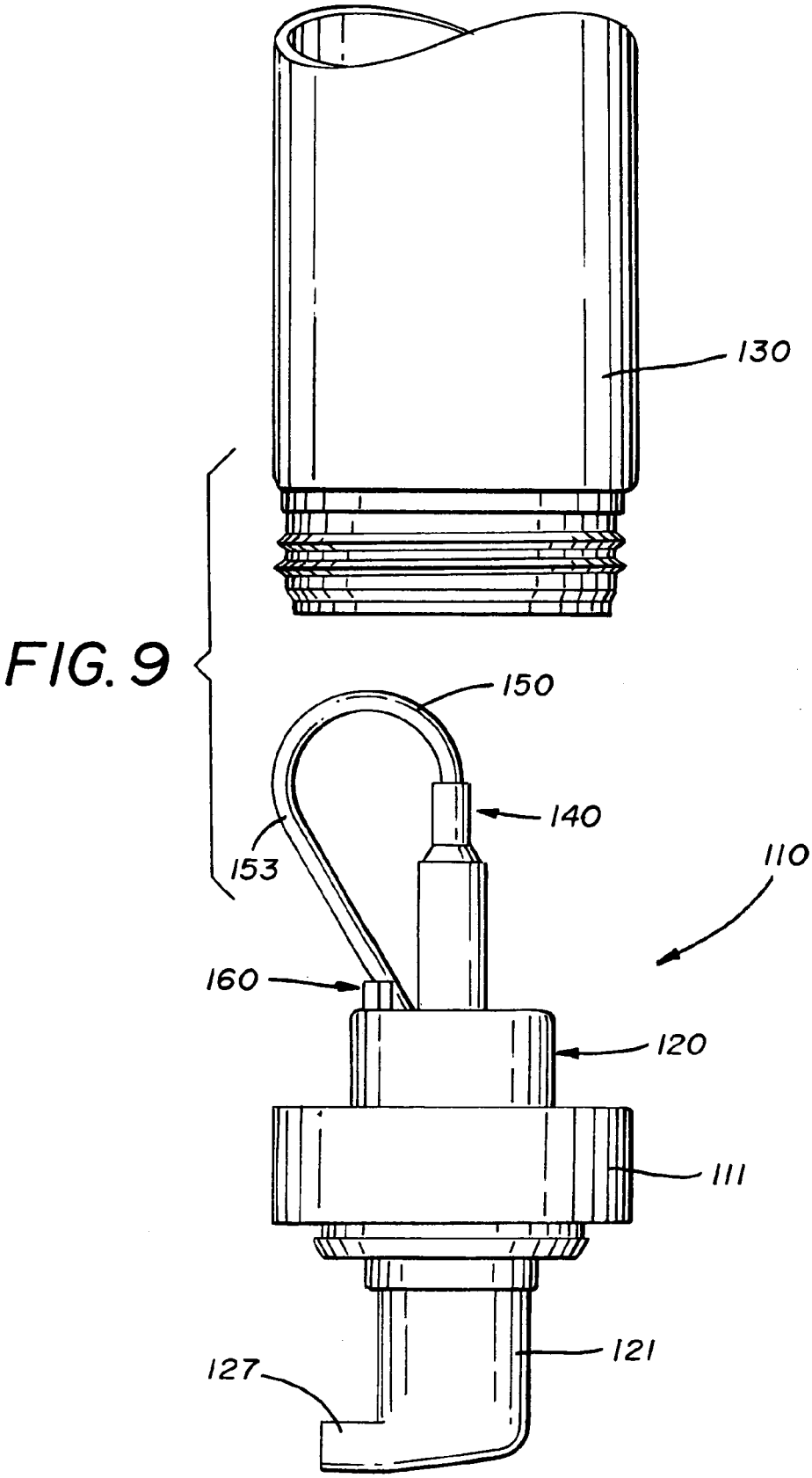
FIG. 9 is an exploded view of a first alternate embodiment of a pumping apparatus according to the concepts of the present invention showing a flexible pump tube that extends from the dip tube and downward toward the base of the pump.
Figure 10:
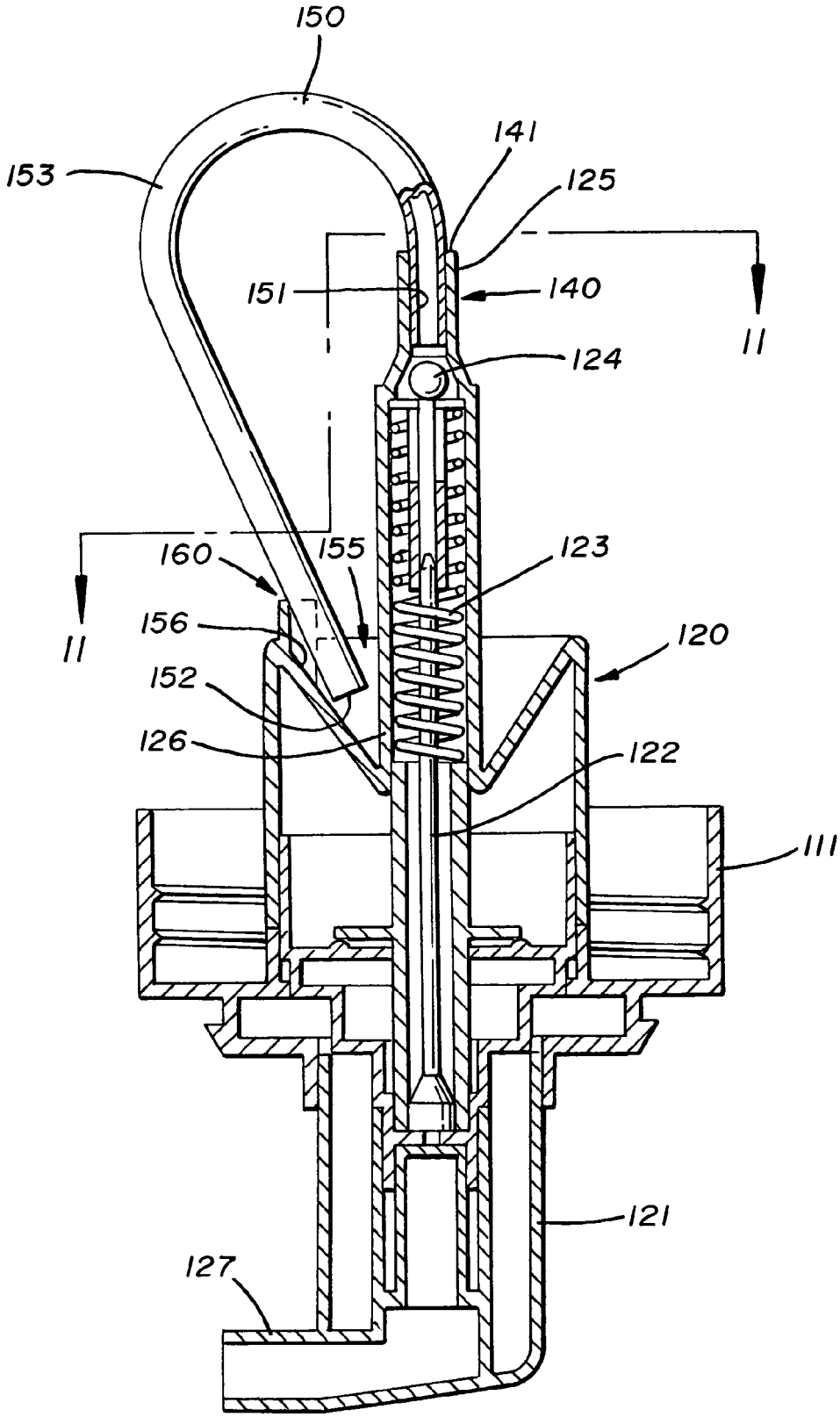
FIG. 10 is an enlarged sectional view of the first alternate pump apparatus.
Figure 11:
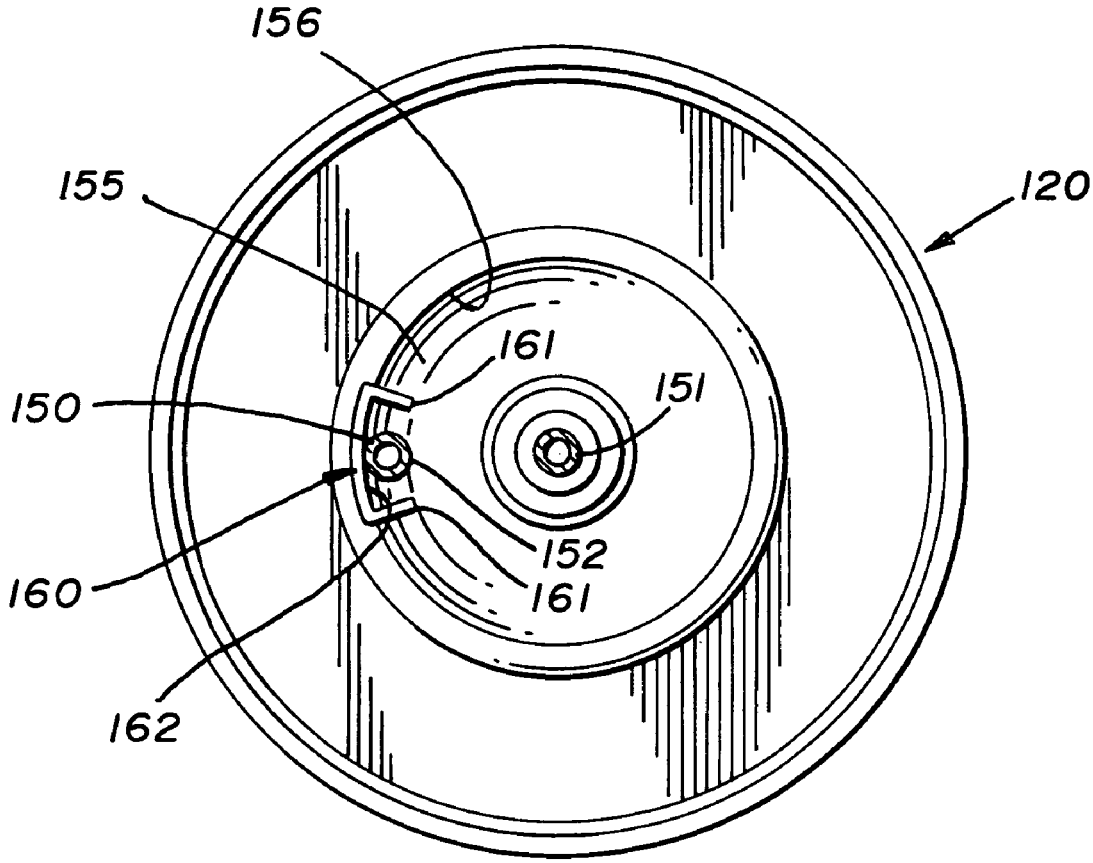
FIG. 11 is a partially sectioned top plan view of the first alternate pump apparatus as might be seen along the line 11—11 in FIG. 10.

FIGS. 9–11 depict a first alternate embodiment of the present invention, generally indicated by the numeral 110. The alternate pumping apparatus 110 shares much of the same structure as the pumping apparatus 10 and, therefore, like numerals will be used to refer to like components. As in the previous embodiment, a pump 120 may be carried by a collar 111 and project into the interior of a container 130. A nozzle end 121 is provided on the pump 120 and projects exteriorly of the container 130 for access by the user as can be seen in FIG. 9. As best shown in FIG. 10, a pump rod 122 projects into the interior of the container 130 through a pump housing 126 and can be actuated by depressing the nozzle end 121 against the force of a spring 123. A check valve, such as, a ball check valve 124 may be disposed at the distal end of the spring 123 to close off the end of the housing 126 during the pumping operation, as will be described more completely below.

A downward extending dip tube, generally indicated by the numeral 150, is received at the distal end 125 of the pump housing 126 within a dip tube support, generally indicated by the numeral 140. The dip tube support 140 includes a hollow attachment portion 141, which may be integrally formed with the pump assembly 120 or press fit on the distal end 125 of the pump housing 126. A dip tube 150 is fit onto the dip tube support 140, as by a press fit, and extends downward toward the pump 120 to draw fluid from the bottom (normal top) of the container 130, when the pump assembly 120 is in an inverted position, as depicted in FIGS. 9 and 10. The dip tube 150 is a tubular member having a first end 151 that opens into the pump housing 126 and a second end 152 that opens into the container 130. The dip tube 150 may be curled and transcend an arc at 153 to position the second end 152 at a point below that of an ordinary dip tube. In the example shown, the second end 152 of the dip tube 150 is brought below the first end 151 of the dip tube 150 and correspondingly the distal end 125 of the pump housing 126. The second end 152 of dip tube 150 may be placed as close as possible to the bottom of the container 130 to make use of the largest quantity of flowable material held therein. In the example shown, the second end 152 is redirected by the arcuate portion 153 such that it extends downwardly, in substantial parallelism to the longitudinal axis of pump body 126 into a cavity 155 defined by the pump 120 adjacent the pump housing 126. The wall 156 of cavity 155 may restrain any radial movement the second end 152 of the curled dip tube 150. To further restrain movement of the curled dip tube 150, such as circumferential movement that might cause loosening of the dip tube 150, a bracket, generally indicated at 160, may be formed on pump assembly 120 adjacent to the wall 156 of the cavity 155. In the example shown in FIGS. 10 and 11, bracket 160 generally includes a pair of arms 161 that extend radially inward defining a gap 162 therebetween in which dip tube 150 may be received.

The dip tube 150 may be rigid or formed of a flexible material to facilitate its installation on the pump assembly 120. As shown, dip tube 150 may be formed as a unitary structure without the second check valve, as depicted in the first embodiment, thereby simplifying manufacture and installation, and reducing the number of parts.

To operate the pump assembly 120 with dip tube 150, the first end 151 may be press fit into the dip tube support 140 and the second end 152 located below first end 151 in a lower portion of the container 130. To that end, when using a flexible dip tube 150, the second end 152 of the dip tube 150 may be bent to appropriately locate the second end 152 in the container 130. For example, the second end 152 may be squeezed inward into the cavity 155 defined by wall 156 of the pump assembly 120 to hold the second end 152 in a downward position. To further restrain the second end 152, this end 152 may be located between arms 161 of bracket 160. In operation, the pump nozzle end 121 is depressed upwardly closing the check valve 124 such that the contents within the pump housing 126 are evacuated at nozzle 127. Upon releasing the nozzle end 121, spring 123 urges the nozzle end 121 downward opening check valve 124 and drawing fluid through the second end 152 of dip tube 150 into the pump housing 126 to ready the pump assembly 120 for the next discharge.

Figure 12:
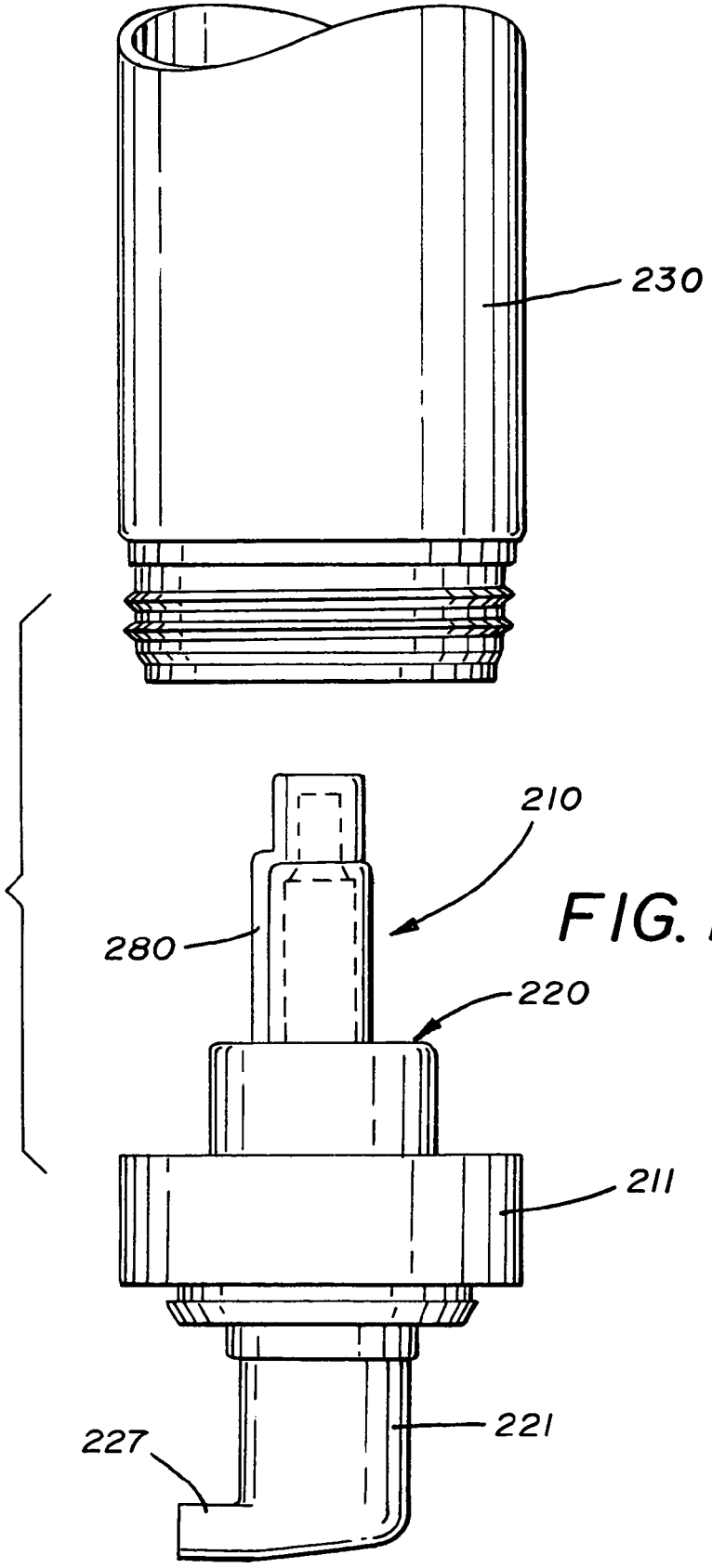
FIG. 12 is an exploded view showing a second alternate embodiment of a pump apparatus according to the concepts of the present invention.
Figure 13:
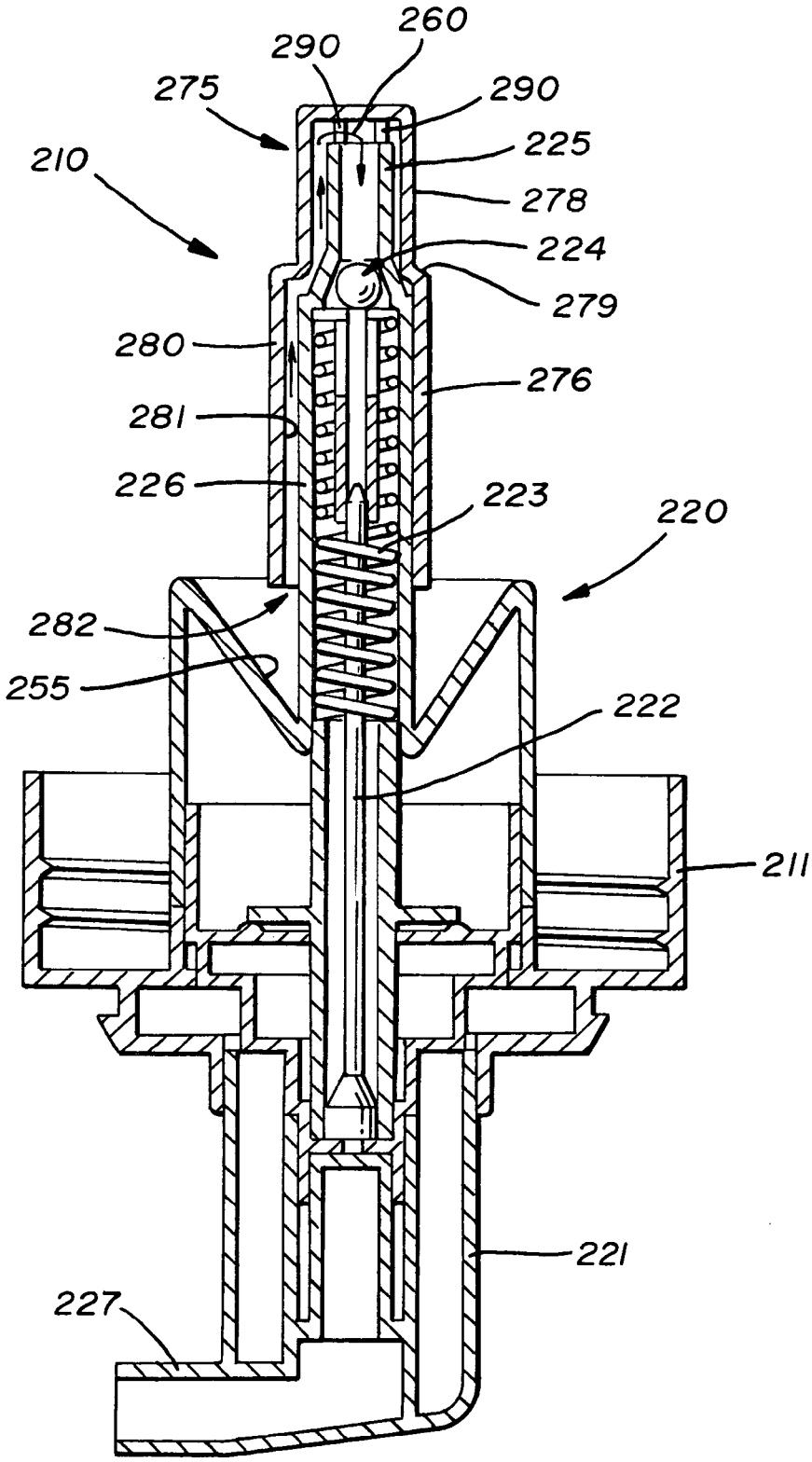
FIG. 13 is a sectional side elevational view of the second alternate pump apparatus.
Figure 14:
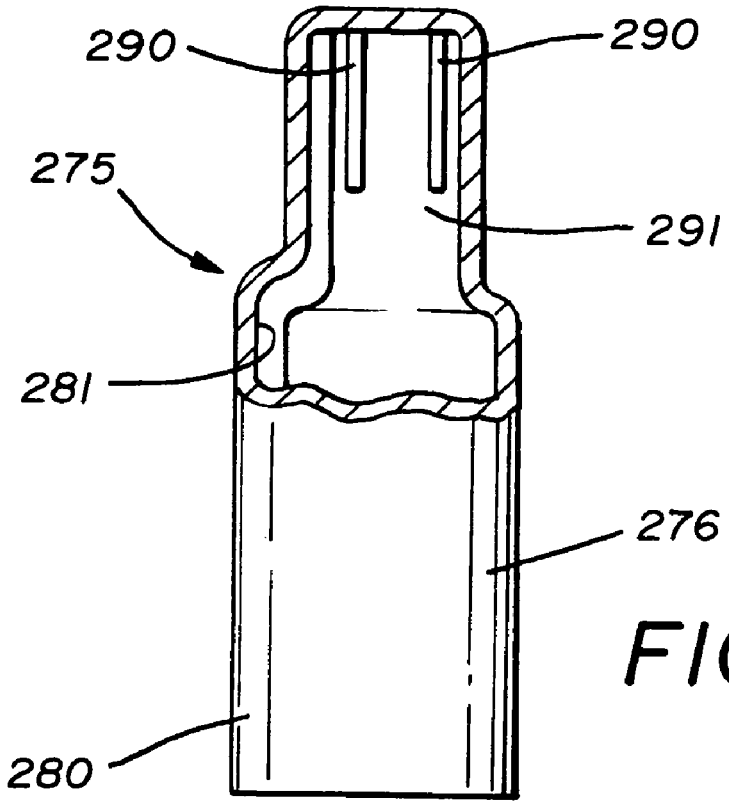
FIG. 14 is an enlarged partially sectioned view of a dip tube cap according to the concepts of the present invention.
Figure 15:
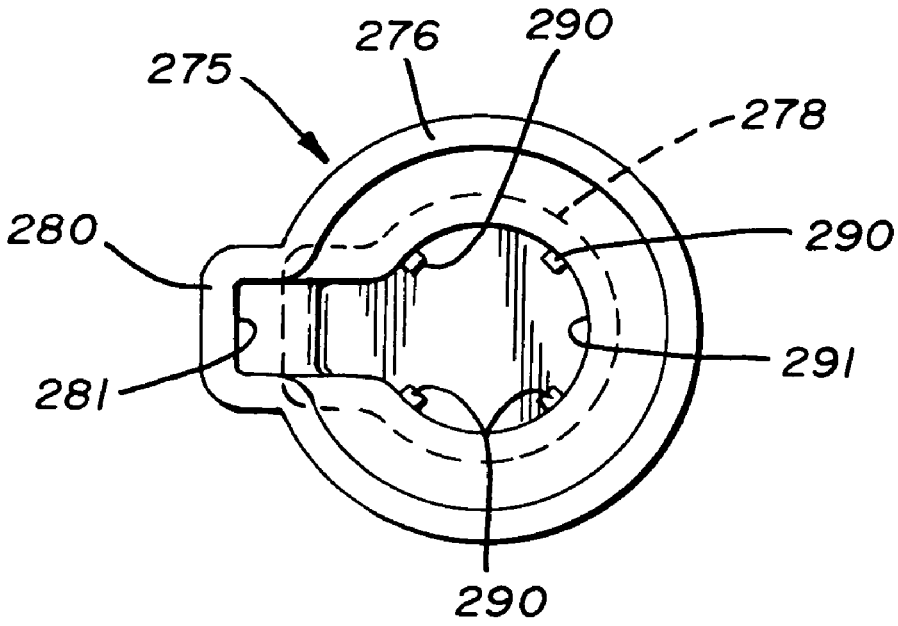
FIG. 15 is a top plan view of the dip tube cap depicted in FIG. 14.

FIGS. 12–15 depict a second alternate embodiment of the present invention, generally indicated by the numeral 210 in the drawings. Since pump assembly 210 includes similar components to the previously described pump assembly, like numerals will be used to refer to like components. As described in the previous embodiments, the pumping apparatus 210 may be attached to a container 230, as may be seen in FIG. 1, that has a top and a bottom. Referring to FIG. 12, the pumping apparatus 210 may include a collar 211 that attaches to the container 230 in a manner well known in the art. A pump 220 is carried by the collar 211 and projects into the interior of the container 230. The pump 220 has a nozzle end 221 that projects exteriorly of the container 230 for access by the user as best shown in FIG. 12. A pump rod 222 (FIG. 13) projects into the interior of the container 230 through the pump housing 226 and can be actuated by depressing the nozzle end 221 against the force of a spring 223. A check valve, which may be a ball check valve, is generally indicated by the numeral 224 and is disposed at a distal end of spring 223 to close the end of the pump housing 226 for purposes that will be described more completely below.

In the second alternate embodiment, a conventional dip tube is replaced by a cap, generally indicated by the numeral 275, that is slidably received over the distal end 225 of the pump housing 226. The cap 275 includes a sleeve 276, which may be circular in section or otherwise shaped to conform to the pump housing 226 such that the cap 275 fits over the distal end 225 of the pump housing 226. The distal end 278 of sleeve 276 may neck inward to form a shoulder 279 that engages a surface on the pump housing 226 to ensure that the end of the cap 275 is spaced from the distal end 225 of the pump housing 226 to allow the free flow of fluid therethrough. A channel 280 may extend radially outward from the sleeve 276 to define a passage 281 through which fluid may be drawn into the pump housing 226. The channel 280 may be segregated from the pump housing 226 by an interior wall, or, as shown, the channel 280 may open radially inward into the sleeve 276 such that pump body 226 acts as the interior wall of the channel 280. In general, the channel 280 extends downward relative to the container and has an open end 282 located below the distal end 225 of the pump housing 226 and preferably near the bottom of the container 230. As shown, channel 280 may follow the contour of pump housing 226 and extend substantially parallel to the pump housing 226. In the example shown, the open end 282 of the channel is located just above a cavity 255 defined adjacent to the pump housing 226.

In operation, the suction created by the pump 220 draws fluid upward through the open end 282 of the channel 280 along the direction of the arrows 260 and inward into the pump housing 226.

While an interference fit may be obtained between the cap 275 and the pump housing 226, the cap 275 may include gripping means that extend inward from the sleeve 276 to engage the pump housing 226. For example, a plurality of ribs 290 may be used to grip the pump housing 226 at its distal end 225. In the example shown four ribs are evenly circumferentially spaced relative to each other on the interior surface 291 of the cap 275 and extend generally in the axial direction. Upon sliding the cap 275 over the distal end 225 of pump housing 226, the ribs 290 engage the distal end 225 and squeeze it therebetween to effect the above described fit. As shown, to prevent the ribs 290 from interfering with the flow of fluid, they may be located on either side of the channel 278. Operation of the pump assembly 210 is largely the same as the previously described embodiments. Depression of the nozzle end 221 pressurizes the interior of the pump housing 226 closing the check valve 224 until the nozzle end 221 is released. Depression of the nozzle end 221 evacuates the flowable material within the housing 226 through nozzle 227. When the nozzle end 221 is released, the spring 223 returns the nozzle end 221 to its open position creating a vacuum that opens the check valve 224 and draws fluid upward through the end 282 of the channel 280 along the line of the arrows 260 and into pump housing 226 readying the pump 220 for the next discharge.

While a full and complete description of the invention has been set forth in accordance with the dictates of the Patent Statutes, it should be understood that modifications can be resorted to without departing from the spirit hereof or the scope of the appended claims.

What is claimed is:

1. A combination dip tube assembly and a container pump for use with a container disposed in an inverted condition, comprising:

a) attachment means for attachment to the container;

b) a pump mechanism carried by said attachment means for dispensing material from the container comprising:

1) a pump movable between pumping and non-pumping positions, and 2) a dip tube extending between said pump and the interior of the container, wherein said dip tube includes a tube having a first and extending upward from said pump mechanism and a second end extending downward relative to said first end an opening below said first end, wherein said first and second ends are connected by an arcuate section;

c) an elongate housing for receipt of a portion of said pump; and d) said dip tube;

1) providing fluid communication between the interior of the container and said pump; and 2) extending in substantial parallelism with said housing;

(e) wherein said tube is a flexible unitary member.

2. A combination dip tube assembly and a container pump for use with a container disposed in an inverted condition, comprising:

a) attachment means for attachment to the container;

b) a pump mechanism carried by said attachment means for dispensing material from the container comprising:

1) a pump movable between pumping and non-pumping positions, and 2) a dip tube extending between said pump and the interior of the container;

c) an elongate housing for receipt of a portion of said pump; and d) said dip tube;

1) providing fluid communication between the interior of the container and said pump; and 2) extending in substantial parallelism with said housing, wherein said dip tube includes a cap slidably received on said pump mechanism, said cap defining a channel adjacent said pump mechanism and opening into said pump mechanism at a first end and opening into said container at a second end, wherein said second is located below said first end.

3. A pump apparatus for use with a container disposed in an inverted condition, the pump apparatus comprising: a pump having a nozzle extending exteriorly of the container and a pump housing extending into the container, wherein said pump housing is open at a distal end thereof; a dip tube having a first end attachable to said distal end and a second end extending below said first end, and a bracket on said pump housing, said bracket being engageable with said dip tube to restrict movement thereof.

4. The pump apparatus of claim 3 further comprising a bracket formed on said pump housing, wherein said bracket is adapted to engage said second end of said tube and restrict movement thereof.

5. The pump apparatus of claim 3, wherein said bracket includes a piar of arms extending radially from said pump housing and defining a dip tube receiving gap therebetween.

6. The pump apparatus of claim 5, wherein said pump housing defines a recess below said distal end, wherein said arms extend radially inward into said recess and wherein said second end of said tube is receivable between said arms within said recess.

7. A pump apparatus for use in connection with a container disposed in an inverted condition, the pump apparatus comprising: a pump housing received within said container and a nozzle extending exteriorly of said container, said pump housing having an open distal end; a cap adapted to fit over a portion of said pump housing including said distal end, said cap defining a channel having a first end opening into said distal end and a second end opening into the container, wherein said second end is located below said first end.

8. The pump apparatus of claim 7, wherein said cap includes a sleeve-like body open at its lower end and closed at its top end, said cap being slidably received on said pump housing, said cap including a surface engageable with said distal end of said pump body to space said closed end of said cap from said open end of said distal end creating fluid communication therebetween, wherein said channel extends radially outward from said opening above said distal end and downward along an outer surface of said pump housing.

9. The pump apparatus of claim 8, wherein said sleeve necks inwardly to define said surface engagable with said pump housing to space said top surface of said sleeve away from said distal end.

10. The pump apparatus of claim 7 further comprising gripping means extending inward from said sleeve and engage the exterior surface of the pump housing.

11. The pump apparatus of claim 10, wherein said gripping means includes a plurality of ribs evenly circumferentially spaced relative to each other located adjacent the distal end of said pump body and engagable therewith.

12. The pump apparatus of claim 8, wherein said ribs extend in the axial direction.

* * * * *